United States Patent [19]

Weible

[11] 4,371,372

[45] Feb. 1, 1983

[54] SIMULTANEOUS DE-SIZING AND REACTIVE DYEING OF CELLULOSE TEXTILES

[75] Inventor: Karl-Heinz Weible, Aesch, Switzerland

[73] Assignee: Sandoz Ltd., Basel, Switzerland

[21] Appl. No.: 278,210

[22] Filed: Jun. 29, 1981

[51] Int. Cl.[3] ..... D06P 1/44; D06P 3/66

[52] U.S. Cl. ..... 8/543; 8/561; 8/918; 435/188

[58] Field of Search ..... 8/543, 561

[56] References Cited

U.S. PATENT DOCUMENTS 2,599,867 6/1952 Schubert ..... 435/188

3,524,798 8/1970 Lloyd et al. ..... 435/188

FOREIGN PATENT DOCUMENTS 2836516 3/1980 Fed. Rep. of Germany .

2909396 9/1980 Fed. Rep. of Germany .

*Primary Examiner*—A. Lionel Clingman

*Attorney, Agent, or Firm*—Gerald D. Sharkin; Richard E. Vila; Thomas C. Doyle

[57] ABSTRACT

By the use of a known bacterial $\alpha$-amylase having significant activity at pH values above 8.5 and temperatures below 30° C., de-sizing and reactive dyeing by the cold dwell process may be carried out simultaneously on cellulose textile materials. The dyed materials have good color yield and levelness and are not hardened.

11 Claims, No Drawings

SIMULTANEOUS DE-SIZING AND REACTIVE DYEING OF CELLULOSE TEXTILES

This invention relates to a process for the simultaneous de-sizing and reactive dyeing of cellulose textiles in the presence of a α-amylases.

During the weaving of cotton textiles, the warp threads are normally protected against breakage by application of size, the most commonly used material being starch, for example potato, maize or rice starch. The presence of size on the warp threads can interfere with finishing processes such as bleaching and dyeing, and complete removal of the size is highly desirable.

Starch sizes are only partially soluble in water and cannot be removed from the fabric by simple washing. Accordingly, enzymatic de-sizing processes have been developed in which the starch is broken down into soluble products by the action of enzymes, particularly α- or β-amylases. α-Amylase of bacterial origin is preferred on account of its rapid action, and this enzyme is effective in a pH range between pH 4.5 and pH 8.5 (see for example "Enzymatic De-sizing of Textiles" by H. Barfoed in *Process Biochemistry,* Aug. 1970, pages 17–19).

It is desirable to combine two separate process steps by de-sizing and dyeing in a single operation, and this is known for direct dyeing of cellulose. However, when the cellulose fabric is to be dyed by a reactive dye, difficulties arise because under the strongly alkaline conditions required for fixation of the reactive dye, the activity of the α-amylase is severely reduced and de-sizing occurs only partially or not at all. Furthermore since the starch size contains hydroxyl groups the reactive dye may become bonded to the size instead of to the cellulose fibres, giving rise to unlevel dyeings, hardening of the material and loss of yield. Thus manufacturers of reactive dyes normally recommend to their customers that all sizes containing hydroxyl groups should be carefully removed before dyeing.

It has now been found that by using a bacterial α-amylase having activity at pH values above 8.5, simultaneous de-sizing and reactive dyeing may be carried out without the disadvantages of unlevel dyeing, hardening and low yield. A further advantage is that de-sizing may be carried out at low temperatures, e.g. 20°–30° C., with consequent savings in energy, and may thus be combined with reactive dyeing by the cold dwell process.

Accordingly, the present invention provides a process for the simultaneous de-sizing and reactive dyeing by the cold dwell process of cellulose textile materials at least some of the fibres of which have been treated with a starch-based size, in which the de-sizing agent is a bacterial α-amylase having significant activity at pH values above 8.5 and at temperatures below 30° C.

Bacterial α-amylase of this type is known and available commercially for example under the trademark "Bactosol TK" (Sandoz, Ltd., Basle, Switzerland) or "Bactamyl" (Gist-Brocades NV, Delft, Holland).

The term cellulose textile materials includes textiles consisting of or containing cellulose fibres. The cellulose may be natural or regenerated cellulose, and is preferably cotton.

The reactive dye and the de-sizing agent may be applied separately to the textile material. However, in a preferred process according to the invention, the textile material is treated with a liquor which contains a cold-dyeing reactive dye, the bacterial α-amylase described above and an alkaline system. The treatment liquor is preferably applied by padding. The padded goods are then preferably rolled up and rotated slowly at room temperature according to the known cold-dwell process, until sufficient fixation of the dye has been achieved.

The treatment liquor may contain any alkaline system conventional for the fixation of reactive dyes, for example sodium carbonate; sodium bicarbonate; alkali metal phosphates, borates and silicates; caustic soda; caustic potash; alkaline earth metal hydroxides and mixtures thereof. These alkaline materials may be present from the beginning or may be added to the liquor during padding, in controlled manner.

The liquor may also contain conventional wetting agents to improve the penetration of the liquor into the fabric. Anionic wetting agents tend to impair the activity of the enzyme, however, and for this reason non-ionic wetting agents are preferred. Anti-foaming agents may also be added to the liquor.

The dyestuffs for use in the process of the invention are conventional cold-dyeing reactive dyes as described for example in the Color Index. Preferred reactive dyes are those which give good colour yield under the conditions of the cold dwell process. Such reactive dyes are well known to the dyer.

The quantity of bacterial α-amylase to be added is the same as that normally recommended for de-sizing, typically from 2–20 g/l, preferably 3–15 g/l of the treatment bath is used. The preferred treatment temperature is in the range of 20°–30° C., but higher temperatures up to 40° C. may be used with reactive dyes of lower activity.

The following Examples, in which all temperatures are in degrees Centigrade, illustrate the invention:

EXAMPLE 1

A starch-sized cotton drill fabric was padded at 25° C. with a liquor of the following composition:

9 g/l of the dyestuff C.I. Reactive Orange 67
5 g/l 'Bactosol TK' bacterial α-amylase
4 g/l wetting agent (nonylphenol ethoxylated with 10 moles ethylene oxide)
10 g/l calcined soda.

The hardness of the water used was 10° D.H., the pH of the liquor was measured electrometrically as 11.1. After two dippings and squeezings, the final pick-up was 70% by weight. The fabric was rolled up, wrapped in plastic film to prevent evaporation, and rotated slowly for 24 hours at 20°. The fabric was then unrolled, cold rinsed, rinsed at 70°, soaped at the boil with 0.5 g/l of a carbomethoxylated fatty alcohol polyglycol ether and again cold rinsed. A level golden yellow dyeing with good colour yield and wet fastness properties was obtained, which was shown by the iodine test to be practically free of starch. The dyed material had a soft handle.

EXAMPLE 2

The procedure of Example 1 was repeated, except that the dyestuff used was 12 g/l C.I. Reactive Red 147. A level deep pink dyeing was obtained, having good colour yield, wet fastness and soft handle and being practically free from starch.

If the soaping bath contains in addition to the detergent 2 g/l soda and 1 ml/1 35% hydrogen peroxide, and soaping is continued for 15 minutes, a purer pink dyeing is obtained due to the simultaneous bleaching of the cotton.

EXAMPLES 3–5

A starch-sized cotton fabric was padded at 25° with liquors of the compositions shown in Table I.

TABLE I

| Example No. | 3 | 4 | 5 |
|---|---|---|---|
| Dyestuff used | Reactive | Reactive Green | Reactive Blue |
| C.I. | Yellow 27 | 6 | 182 |
| conc. g/l | 30 | 40 | 20 |
| Baktosol TK liquid (g/l) | 7 | 5 | 5 |
| non-ionic wetting agent (g/l) | 4 | 4 | 4 |
| urea (g/l) | 100 | 200 | — |
| calcined soda (g/l) | 30 | — | 20 |
| sodium bicarbonate (g/l) | — | 20 | — |
| silicone-based anti-foaming agent (g/l) | — | 0.1 | — |
| pH of liquor | 11 | 9.8 | 10.8 |
| colour of dyeing | golden yellow | olive green | blue |

The dyeing was carried out as described in Example 1, giving level dyeings of the colours shown in Table I having good colour yield, wet fastness and handle, and good removal of size.

I claim:

1. A process which comprises the steps of (1) applying a cold-dyeing reactive dye and, as de-sizing agent, a bacterial α-amylase to a cellulose textile material at least some of whose fibers have been treated with a starch-based size, said α-amylase having significant activity at pH values above 8.5 and at temperatures below 30° C. and (2) subjecting the thus-treated material to the cold-dwell process until sufficient fixation of the dye has been achieved, whereby simultaneous de-sizing and reactive dyeing of the material is effected.

2. A process as claimed in claim 1 comprising the step of applying to the cellulose textile material a liquor containing the cold-dyeing reactive dye, the bacterial α-amylase and an alkaline system.

3. A process as claimed in claim 2 in which the liquor contains a non-ionic wetting agent.

4. A process according to claim 2 which is effected at a temperature of 20°–40° C.

5. A process according to claim 4 which is effected at a temperature of 20°–30° C.

6. A process according to claim 1, 2 or 4 wherein the α-amylase has significant activity at a pH of 9.8 to 11.1.

7. A process according to claim 1, 2 or 4 which is carried out at a pH of 9.8 to 11.1.

8. A process according to claim 7 wherein the cellulose textile material is cotton.

9. A process according to claim 2 wherein the alkaline system is selected from the group consisting of sodium carbonate, sodium bicarbonate, alkali metal phosphates, alkali metal borates, alkali metal silicates, caustic soda, caustic potash, alkaline earth metal hydroxides and mixtures thereof.

10. A process according to claim 4 wherein the amount of α-amylase is 2 to 20 grams per liter of treatment liquor.

11. A process according to claim 7 wherein the amount of α-amylase is 2 to 20 grams per liter of treatment liquor.

* * * * *